United States Patent [19]

Allen

[11] Patent Number: 4,679,418

[45] Date of Patent: Jul. 14, 1987

[54] HIGH SECURITY CYLINDER LOCK

[76] Inventor: Mark L. Allen, 1776 E. 13th St., Brooklyn, N.Y. 11229

[21] Appl. No.: 847,183

[22] Filed: Apr. 2, 1986

Related U.S. Application Data

[63] Continuation-in-part of Ser. No. 685,222, Dec. 26, 1984, Pat. No. 4,593,546.

[51] Int. Cl.[4] ..... E05B 9/10

[52] U.S. Cl. ..... 70/380; 70/134; 70/417

[58] Field of Search ..... 70/379 R, 380, 129, 70/134, 448, 449, 451, 370, 189, 175, 375, 417, 423, 454; 292/142

[56] References Cited

U.S. PATENT DOCUMENTS

| | | | |
|---|---|---|---|
| 1,125,791 | 1/1915 | Aston | 70/134 |
| 1,411,898 | 4/1922 | Augenbraun | 70/417 |
| 1,461,756 | 7/1923 | Croning | 70/451 X |
| 3,605,461 | 9/1971 | Frank | 70/380 X |
| 3,698,216 | 10/1972 | Keller-Volper | 70/380 |
| 3,808,854 | 5/1974 | Mercurio | 70/375 X |
| 3,992,908 | 11/1976 | Crerisek | 70/370 |
| 4,012,931 | 3/1977 | Harunari | 70/386 X |
| 4,593,546 | 6/1986 | Allen | 70/380 |

FOREIGN PATENT DOCUMENTS

| | | | |
|---|---|---|---|
| 0022233 | 1/1981 | European Pat. Off. | 70/380 |
| 825218 | 12/1951 | Fed. Rep. of Germany | 70/370 |
| 1106637 | 5/1961 | Fed. Rep. of Germany | 70/134 |
| 1200331 | 12/1959 | France | 70/129 |
| 909652 | 10/1962 | United Kingdom | 70/134 |

*Primary Examiner*—Robert L. Wolfe

*Attorney, Agent, or Firm*—William P. Keegan

[57] ABSTRACT

A cylinder operated deadbolt lock in which a solid housing is provided with bores and apertures only to accommodate the lock components, such as the lock cylinder, the lock bolt, and the bolt moving mechanism. The lock bolt is thrown and withdrawn by a pinion bolt moving mechanism which engages a rack formed on the bolt. The lock is further provided with a drill resistant guard plate which is mounted in the housing and protects the lock cylinder against drilling.

4 Claims, 6 Drawing Figures

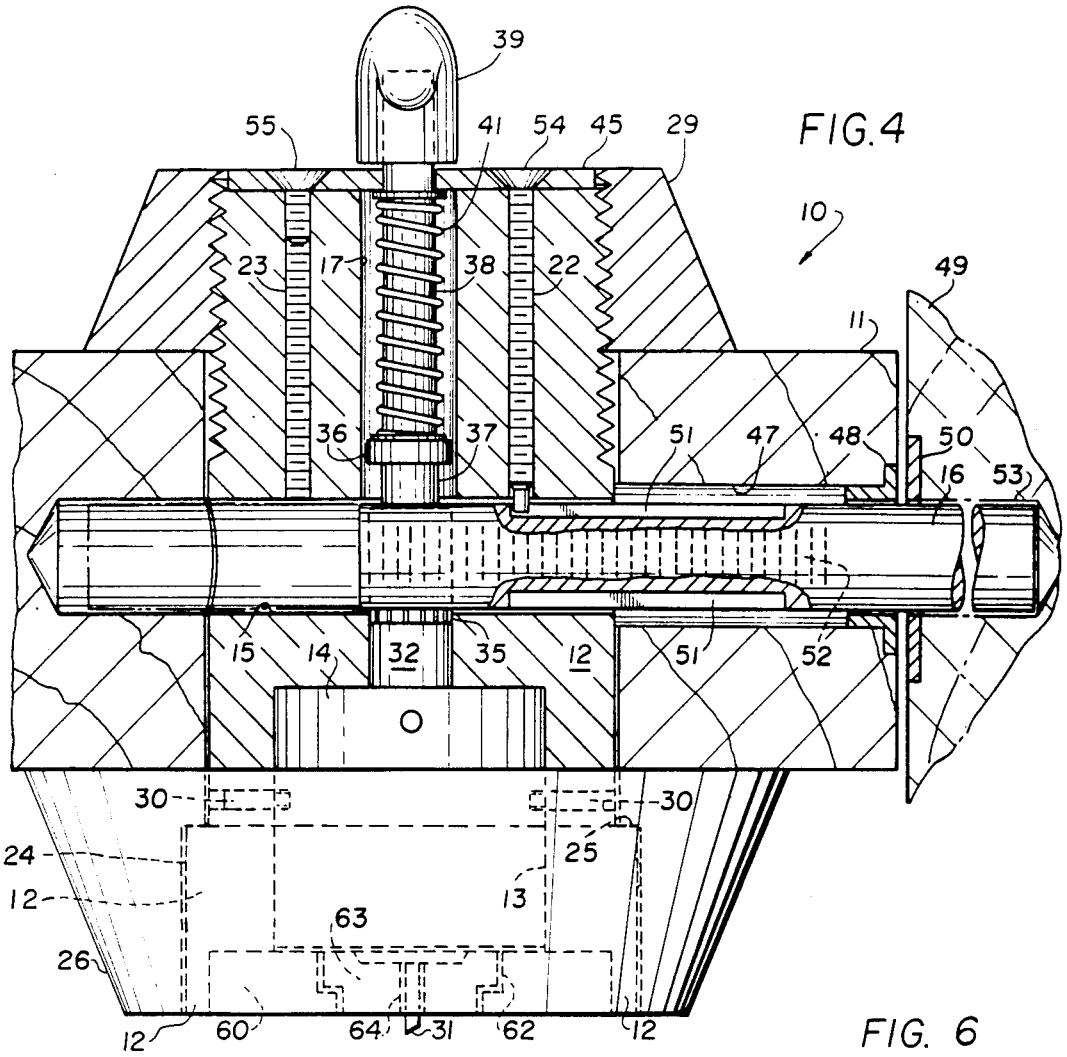
FIG. 4
FIG. 5
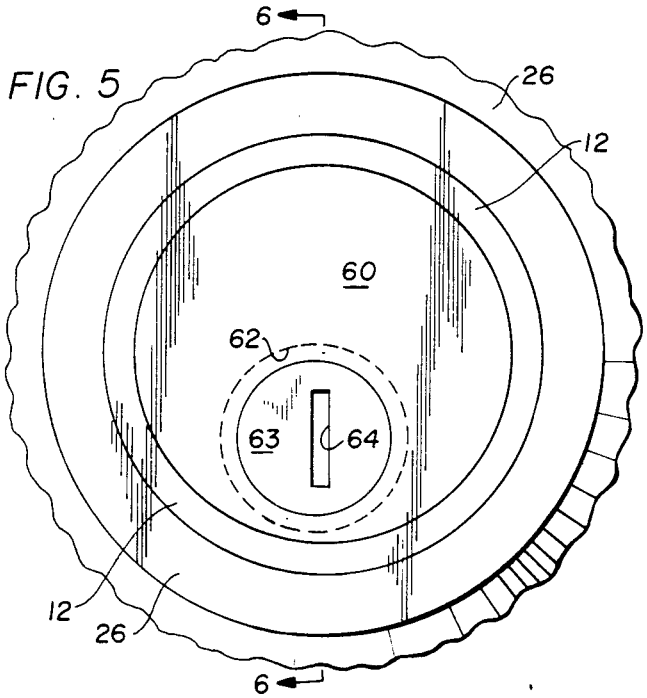
FIG. 6
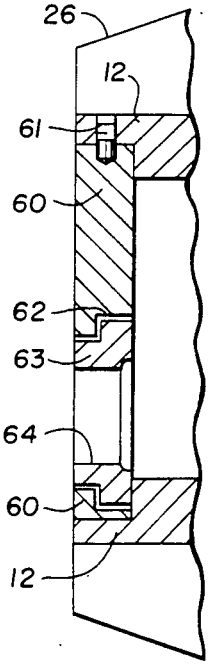

HIGH SECURITY CYLINDER LOCK

This is a continuation-in-part application of co-pending application Ser. No. 685,222 filed Dec. 26, 1984 and now U.S. Pat. No. 4,593,546.

FIELD OF THE INVENTION

This invention relates to deadbolt locks and more particularly to high security single cylinder operated deadbolt locks.

BACKGROUND OF THE INVENTION

While deadbolt locks have in the past adequately secured doors and the like against unauthorized entry, they are now being subjected to unprecedented abuse and assault. Cylinder operated locks have been provided with pick resistant cylinders, but picking of the lock is not always the major problem to be guarded against. Rather, the cylinder may be pried from its setting by a crowbar, gripping pliers, or similar tool, or it may simply be drilled out. Escutcheons are often provided to encircle a lock cylinder to prevent a tool being inserted into the door adjacent the periphery of the cylinder and used to pry the cylinder out of the lock. In the absence of an escutcheon, this could be done because the cylinder is normally held in place by two machine screws which pass through a retaining plate on the inside of the door and into the back side of the cylinder, thus holding the cylinder in position on the outside of the door. When subjected to the force exerted by a crowbar, the screws simply fail in tension thus allowing the cylinder to pop out of the lock. To prevent drilling of the cylinder, a hardened steel guard plate is often mounted in front of the cylinder to defeat the effort of removing the cylinder by drilling. With the cylinder removed, either by prying or drilling, the bolt can easily be withdrawn from engagement with the door jamb.

BRIEF DESCRIPTION OF THE INVENTION

The object of the present invention is to provide an improved high security cylinder operated lock.

It is another object of the invention to provide a cylinder operated deadbolt lock that better resists violent removal of the cylinder from its setting, either by prying or by drilling.

It is yet another object of the invention to provide an improved deadbolt lock that has an extremely high resistance to jimmying, bending, cutting, drilling, twisting, or other assault on the integrity of the lock.

It is still another object of the invention to provide a cylinder operated deadbolt lock that is inexpensive to manufacture and easy for a locksmith to install.

In carrying out the invention, there is provided a lock housing that extends transversely through a door and which encompasses the lock operating cylinder and the bolt moving mechanism of the lock. The bolt extends from within the housing through an aperture therein and through a bolt hole provided in the edge of the door. More particularly, a solid cylindrical housing is provided to extend through the entire thickness of the door and be secured in place by an internally threaded collar on the inside of the door. A collar is also provided for the outside of the door, and it is freely rotatable with respect to the housing. A bolt extends through an aperture in the sidewall of the housing and a part of the bolt always remains in the housing when the bolt is extended into the door jamb to lock the door. The bolt throwing and retracting mechanism is secured within another aperture provided in the housing as is the key operated cylinder which enables the bolt to be actuated by a key from the outside of the door. The housing is also adapted to secure a drill resistant guard plate adjacent the outside surface of the cylinder, and the guard plate in turn is adapted to rotatably hold a slotted disk in front of the cylinder plug. The key that actuates the bolt is inserted through the slot into the plug, and the key, slotted disk, and cylinder plug are rotated together. A suitable mechanism, which may also be a key operated cylinder, is provided to actuate the bolt from the inside of the door.

A feature of the invention is that the lock structure minimizes the liklihood of the cylinder being removed from the lock, as by working a crowbar or other prying tool into position behind the cylinder so as to pry or pop the cylinder out of the door, or by directly drilling or cutting the cylinder from the door.

Another feature of the invention is that the lock structure, with the bolt always extending into the solid lock housing, prevents the lock from being twisted in the door.

Other features and advantages of the invention may be gained from the foregoing and from the description of a preferred embodiment of the high security lock which follows.

DESCRIPTION OF THE DRAWING

FIG. 4 is a top plan view, partly in section, of the lock shown in FIG. 1;

FIG. 5 is a front elevational view, i.e., looking at the outside of the door, of the lock shown in FIG. 1; and FIG. 6 is a fragmentary sectional view taken along line 6—6 of FIG. 5.

DETAILED DESCRIPTION OF THE INVENTION

Figure 1:
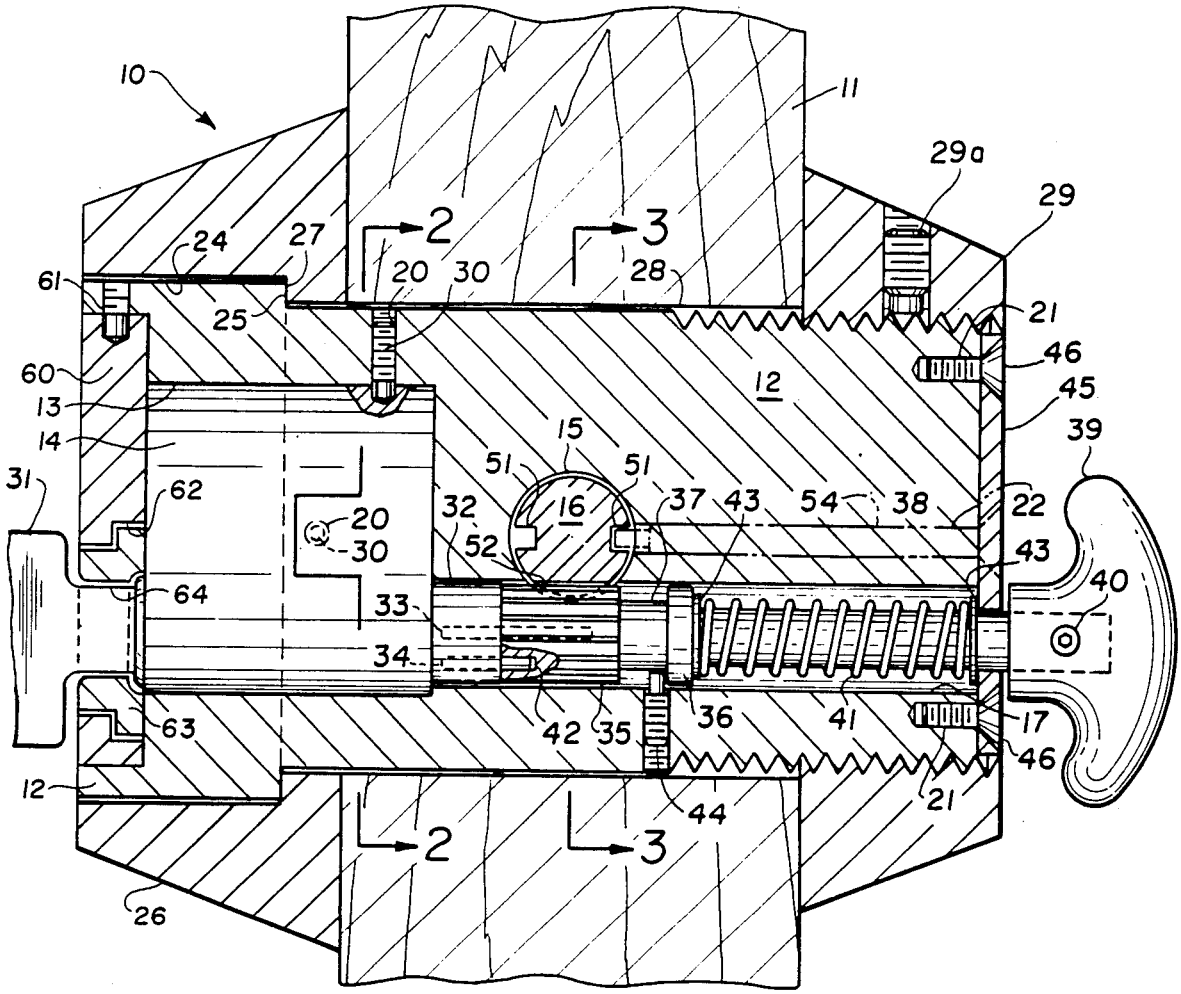
FIG. 1 is a side elevational view, partly in section, of a high security single cylinder lock according to the present invention.
Figure 2:
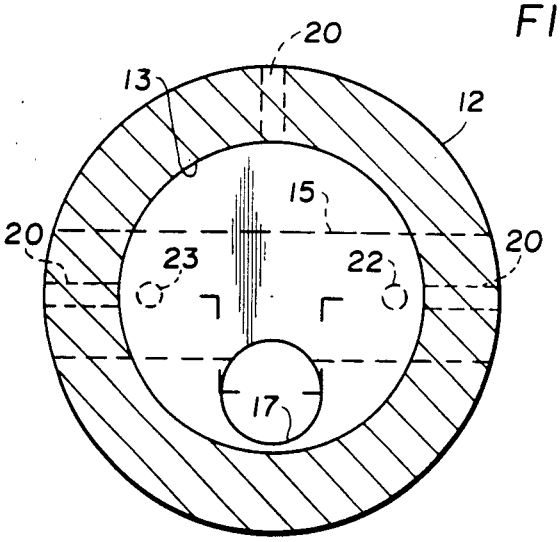
FIG. 2 is a sectional view of the lock housing taken along line 2—2 of FIG. 1.
Figure 3:
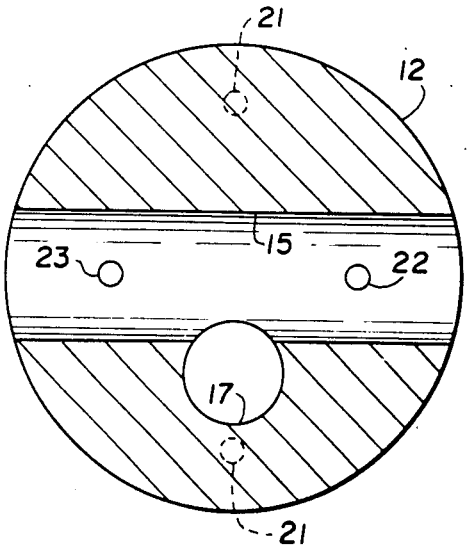
FIG. 3 is a sectional view of the lock housing taken along line 3—3 of FIG. 1.

Referring now to FIG. 1, the high security single cylinder lock 10 of the present invention is shown mounted in a door 11, which may be either a wooden door or a hollow metal door. Lock 10 comprises principally a cylindrical housing 12 machined from a solid bar of steel or other suitable material. As shown in FIGS. 2 and 3, housing 12 is provided with a plurality of cylindrical apertures or bores to accommodate various lock components as hereinafter described. Bore 13, which extends partway through the length of the housing will receive a lock cylinder 14, while transverse aperture 15 will form the setting for the locking bolt 16. A smaller diameter bore 17, extending from the bottom, i.e., the right end of bore 13 (FIG. 1), of bore 13 to the opposite face of the housing will have the bolt actuating mechanism placed therein. Setscrews will be threaded into screw holes 20 to secure a lock cylinder in bore 13 of housing 12 while screw holes 21 will receive the screws for fastening an escutchion plate to the inside end of housing 12. One of threaded screw holes 22 and 23, extending from the inside end of housing 12 to the locking bolt aperture 15, will have a guide screw placed therein to guide and limit the movement of the locking bolt. All of this will later be described, but the present intention is to emphasize that lock housing 12 is a solid piece of metal with the minimum amount of material removed therefrom, only that which is necessary to accommodate the lock components. The housing is further formed with a rim 24 that provides a substantial shoulder 25. The housing is also provided with external threads at the end remote from rim 24.

The arrangement for securing the housing 12 in a door will now be described, but it is to be understood that most of the lock components hereinafter described will be assembled in housing 12 before the housing is secured in a door. A collar 26 is formed with an annular shoulder 27 which cooperates with the shoulder 25 of rim 24 so that the outside faces of housing 12 and collar 26 will be co-planar. Collar 26, like housing 12, will be made of hardened steel or other suitable material. The housing will be slipped through collar 26, as shown, and inserted in the door. On the inside of the door, a second collar 29, provided with internal threads, will be threaded onto housing 12 to draw collar 26 tightly against the outside of door 11. A setscrew **29*a* will prevent collar 29 from being unscrewed from housing 12. It is noted that collar 26 is not secured to housing 12. Thus, anyone using a tool or wrench to grip the periphery of collar 26 with the intention of twisting or rotating housing 12 to break or bend the lock bolt would only be able to rotate the collar around housing 12**.

Referring again to FIG. 1, a lock cylinder 14 is secured within housing 12 by a plurality of setscrews 30 threaded through holes 20 in housing 12 into apertures provided in cylinder 14. Some of the holes 20 will be located in the plane of collar 26 and others in the plane of door 11. Cylinder 14, preferably a pick resistant cylinder, also may be protected by a guard plate 60 fitted into an outer extension of housing 12 and secured therein by setscrews 61 threaded through housing 12 into the periphery of the guard plate. Guard plate 60 will be formed of drill resistant hardened steel. The guard plate is provided with an aperture 62 through which a key 31 may be inserted into the cylinder plug 32 to rotate it in the usual fashion and so actuate the lock bolt. For further lock protection, a rotatable slotted disk 63 having a peripheral shoulder that abuts a corresponding aperture shoulder may be mounted in aperture 62 as shown. In such case, key 31 will pass through slot 64 of disk 63 for insertion into the cylinder plug, and when the key is rotated to actuate the lock bolt, disk 63 will rotate along with the cylinder plug 32.

Plug 32 is provided with a central pin 33 and an eccentrically mounted shorter pin 34. Pin 33 serves as a support for the bolt actuating pinion 35 which can rotate on pin 33 as well as slide axially thereon. Shorter pin 34 will engage pinion 35 when the lock is dormant, but it will be disengaged therefrom when the pinion is moved axially in pin 33 as hereinafter described.

Pinion 35 is integrally formed with a retainer member 36 having a peripheral groove 37 and an extension rod 38 which extends outwardly of lock 10 and to which a thumb turn 39 is secured as by setscrew 40. A spring 41 positioned over rod 38 biases pinion 35 leftwardly as shown in FIG. 1 so that pin 33 is inserted into hole 42 provided in the end face of pinion 35. Washers 43 may be provided as bearing surfaces for the ends of spring 41. A setscrew 44 projecting into groove 37 will limit the distance pinion 35 can move away from cylinder plug 32. The distance will be sufficient, however, to disengage pin 34 from pinion 35.

On the inside end of housing 12, an escutcheon 45 is provided. It is secured to the housing by countersunk screws 46 threaded into screw holes 21.

Referring now to FIG. 4, lock 10 is shown with bolt 16 in locking position. In this position, bolt 16 extends from inside housing 12 through aperture 15 provided in the sidewall of the housing, through hole 46 drilled in door 11 and faceplate 48 mounted on the edge of the door, into door jamb 50. The bolt is preferably a hardened steel cylindrical rod provided with guide grooves 51 on each side thereof. The underside of bolt 16 is formed with a rack 52 so that it may engage with and be moved by pinion 35.

Lock 10 is assembled as follows. Cylinder 14 is secured in housing 12 by setscrews 30 and guard plate 60 is secured by setscrews 61. Before securing plate 60, disk 63 will be positioned as shown. Pinion 35 is engaged with pins 33 and 34 and spring 41 is placed over rod 38. Escutcheon 45 is fitted on rod 38 and secured to housing 12 by screws 46. Setscrew 44 is threaded through housing 12 until it projects into groove 37 of member 36.

To install lock 10 in a door, first hole 28 is drilled through door 11 to accommodate housing 12. Then hole 47 is drilled to accommodate bolt 16. A similar, but shallower, hole 53 is drilled in door jamb 49 to receive the extended bolt. Next, collar 26 is slipped over housing 12 and the housing inserted through hole 28. Collar 29 is then threaded onto housing 12 to secure the assembled lock in door 11. Bolt 16 is then inserted from the edge of door 11 into hole 47 and through aperture 15 in housing 12 until it engages pinion 35. At this time, pinion 35 is disengaged from pin 34 as by pulling thumb turn 39 to the right, as viewed in FIG. 1, so that the pinion may turn freely on pin 33. When the end of bolt 16 is flush with faceplate 48, pinion 35 will be positioned such that hole 42 will be aligned with pin 34. Thumb turn 39 may then be released so that spring 41 causes pinion 35 to move axially and engage pin 34. Guide screw 54 will then be threaded through screw hole 22 until it projects into groove 51 formed in the side of bolt 16. The screw 54, at this time, will contact the left hand end of groove 51 (FIG.4) and so limit the extent of withdrawal of bolt 16 into door 11. At the same time, it is assured that pinion 35 is positioned with hole 42 aligned with pin 34 of cylinder plug 32. A short screw 55 is threaded into second screw hole 23 to give a finished appearance to escutcheon 45. The second screw hole 23 is provided so that the lock 10 can be installed in an opposite handed door in which the bolt would project to the left (FIG. 4) instead of to the right as shown. In such case, guide screw 54 would be threaded through the leftward screw hole 23 and it would engage the groove 51 on the opposite side of bolt 16. Thumb turn 39 is then fastened to rod 38 as by setscrew 40, thus completing the installation of the lock.

In operation, the lock would normally be in the position as shown in FIG. 1 with pinion 35 engaging pin 34. This is so whether the bolt 16 is fully extended, as in FIG. 4, or withdrawn with the leading end of the bolt flush with faceplate 48. To actuate the bolt from the outside of the door, either to extend or to withdraw the bolt from its locking position, key 31 is inserted into cylinder plug 32 and rotated one complete revolution in the appropriate direction, thus causing pin 34 to rotate pinion 35 and move bolt 16. The inside thumb turn 39 will also rotate when cylinder plug 32 is rotated by key 31, but this has no adverse effect. When the bolt is extended into door jamb 49 and pinion 35 is engaged by pin 34, the bolt will be deadlocked when key 31 is removed from cylinder plug 32. To actuate the bolt from inside the door, as by turning thumb turn 39, pinion 35 must be disengaged from pin 34 as by pulling thumb turn 39 against the bias of spring 41. When so disengaged, the thumb turn can be rotated to extend or to withdraw the bolt. At the end of one complete rotation of thumb turn 39, the thumb turn is released and spring 41 causes pinion 35 to engage pin 34. Thus, the various parts of the lock are in position for subsequent actuation either by key 31 or by thumb turn 39.

Having thus described the invention, it is to be understood that many apparently different embodiments thereof can be made without departing from the spirit and scope of the invention. For example, different cylinders such as small diameter or wafer tumbler cylinders could be used, as could different bolt driving mechanisms such as cam drives. A double cylinder lock of the type disclosed in the aforementioned co-pending application could be provided instead of the single cylinder lock herein disclosed. In any case, the lock housing will be a solid cylinder drilled only to accommodate the lock components provided, thus assuring maximum security for the lock. Therefore, it is intended that the foregoing specification and the accompanying drawing be interpreted as illustrative rather than in a limiting sense.

What is claimed is:

1. A high security door lock comprising: a lock housing comprising a solid cylindrical member having an outwardly projecting rim at one end thereof, said rim providing an external shoulder spaced from said one end, the other end of said cylindrical member being threaded so that a flange means can be threaded onto said cylindrical member, said cylindrical member being provided at said one end with an axial bore having a depth greater than the longitudinal length of a lock cylinder, a second longitudinal bore extending from the bottom of said axial bore to said other end of said cylindrical member, a bolt receiving bore intersecting at least a portion of said second bore and extending transversely through said cylindrical member so that a bolt can be inserted therein from either side of said cylindrical member; lock cylinder means including a key operated plug positioned at the bottom of said first bore so as to leave a space in said bore at said one end of said housing in front of said lock cylinder, said lock cylinder means being provided with a bolt moving member extending into said second bore; bolt driving means mounted in said second bore in position to be actuated by said bolt moving member of said lock cylinder to drive a bolt into and out of a locking position; a solid bolt slidably positioned in said bolt receiving bore so that a portion thereof engages said bolt driving means, said bolt when driven to a locking position remaining in engagement with said bolt driving means and in said bolt receiving bore so as to prevent said cylindrical member being rotated in a door in which it is installed; an annular collar member having an internal shoulder and adapted to slide over said cylindrical member so that when the shoulder of said collar member abuts the shoulder of said cylindrical member the end of said collar member is flush with said one end of said cylindrical member and can rotate freely theron; flange means threaded onto the threaded end of said cylindrical member to engage the inner side of a door in which the lock is installed; second bolt moving means mounted in said second bore and extending to said other end of said cylindrical member, said second bolt moving means being adapted to disengage said bolt driving means from said bolt moving member of said lock cylinder and to actuate said bolt driving means when the latter is so disengaged; a guard plate positioned in and substantially filling the space in said bore in front of said lock cylinder, said guard plate having an aperture aligned with said cylinder plug whereby a key may be inserted through said aperture and into said plug so as to actuate said bolt moving member; and means extending from the sidewall of said housing into the peripheral edge of said guard plate to secure said guard plate in said housing.

2. A high security door lock according to claim 1 wherein said bolt driving means comprises rotatably mounted pinion means connected to said second bolt moving means and supported for sliding movement into and out of engagement with said bolt moving member of said lock cylinder, wherein said bolt is provided with a rack section that engages said pinion means, and wherein said lock cylinder bolt moving member includes an eccentrically mounted pin projecting into the sidewall of said pinion means, and including means for biasing said pinion means into engagement with said bolt moving member.

3. A high security door lock according to claim 1 wherein said guard plate is made of drill resistant material.

4. A high security door lock according to claim 3 including a disk rotatably mounted in the aperture of said guard plate, said disk being provided with a key slot through which a key may be inserted into said cylinder plug.

* * * * *